US006807962B2

(12) United States Patent
Taplan et al.

(10) Patent No.: US 6,807,962 B2
(45) Date of Patent: Oct. 26, 2004

(54) KITCHEN GAS COOKING STOVE WITH A GLASS-CERAMIC, GLASS, OR CERAMIC TOP, A GAS COOKTOP WITH A GLASS-CERAMIC, GLASS, OR CERAMIC TOP, AND A GLASS-CERAMIC, GLASS, OR CERAMIC TOP OF A COOKING STOVE OR COOKTOP WITH A VENTING STRUCTURE THEREON

(75) Inventors: Martin Taplan, Rheinböllen (DE); Theodore Allen Wegert, Louisville, KY (US)

(73) Assignee: Schott Glas, Mainz (DE)

( * ) Notice: Subject to any disclaimer, the term of this patent is extended or adjusted under 35 U.S.C. 154(b) by 76 days.

(21) Appl. No.: 10/059,052

(22) Filed: Jan. 28, 2002

(65) Prior Publication Data

US 2003/0140918 A1 Jul. 31, 2003

(51) Int. Cl.[7] ..... F24C 3/08
(52) U.S. Cl. ..... 126/39 B; 126/214 A
(58) Field of Search ..... 126/39 R, 39 B, 126/39 E, 211, 214 A, 214 R, 214 C, 214 D, 212, 215, 42

(56) References Cited

U.S. PATENT DOCUMENTS

| | | | | | |
|---|---|---|---|---|---|
| 3,782,475 | A | * | 1/1974 | Schmidt | 169/50 |
| 4,304,897 | A | * | 12/1981 | Bluestein | 528/20 |
| 4,492,217 | A | | 1/1985 | Scheidler | 126/39 B |
| 5,046,477 | A | | 9/1991 | Bennett et al. | 126/39 B |
| 5,259,361 | A | * | 11/1993 | LeStrat et al. | 126/39 J |
| 5,313,929 | A | | 5/1994 | Thürk et al. | 126/39 B |
| 5,653,219 | A | * | 8/1997 | Taplan et al. | 126/39 R |
| 6,098,613 | A | * | 8/2000 | Wiersma | 126/273 R |
| 6,505,621 | B2 | * | 1/2003 | Gabelmann | 126/214 R |

FOREIGN PATENT DOCUMENTS

| | | | | |
|---|---|---|---|---|
| DE | 2819118 | | 9/1982 | |
| DE | 4133409 | | 10/1993 | |
| DE | 4311758 | | 10/1994 | |
| DE | 4442572 | | 9/1995 | |
| DE | 19838214 | | 2/2000 | |
| FR | 2 699 260 | A1 * | 6/1994 | F24C/15/02 |
| GB | 2 090 399 | A * | 7/1982 | F24C/15/10 |
| JP | 8-233291 | A * | 9/1996 | F24C/15/10 |

OTHER PUBLICATIONS

Heidelberger Bauchemie GMBH Material Safety Data Sheet According to 91/155 EC, pp. 1–6.

* cited by examiner

*Primary Examiner*—Josiah Cocks
(74) *Attorney, Agent, or Firm*—Nils H. Ljungman & Associates

(57) ABSTRACT

There is now provided a kitchen gas cooking stove with a glass-ceramic, glass, or ceramic top, a gas cooktop with a glass-ceramic, glass, or ceramic top, and a glass-ceramic, glass, or ceramic top of a cooking stove or cooktop with a venting structure thereon. A component-part is mounted on the top in a cutout portion with an attachment that prevents contact between the component-part and the top and seals the cutout portion from cooking spills to prevent spills on the top from seeping along said attached silicone body toward the cutout portion.

21 Claims, 10 Drawing Sheets

KITCHEN GAS COOKING STOVE WITH A GLASS-CERAMIC, GLASS, OR CERAMIC TOP, A GAS COOKTOP WITH A GLASS-CERAMIC, GLASS, OR CERAMIC TOP, AND A GLASS-CERAMIC, GLASS, OR CERAMIC TOP OF A COOKING STOVE OR COOKTOP WITH A VENTING STRUCTURE THEREON

BACKGROUND OF THE INVENTION

1. Field of the Invention

This invention relates to a kitchen gas cooking stove with a glass-ceramic, glass, or ceramic top, a gas cooktop with a glass-ceramic, glass, or ceramic top, and a glass-ceramic, glass, or ceramic top of a cooking stove or cooktop with a venting structure thereon.

2. Background Information

In cooking stoves in which component-parts, such as, gas burners, or vapor removal structures, such as a venting structure, are arranged in the top, there arises the danger that the plate or top may become damaged upon contact of the component-part with the plate upon installation and removal of the component-part in the top.

In German Patent No. 41 33 409 C2 (corresponding to U.S. Pat. No. 5,313,929) an assembly is described in which at the edge portion, or periphery, of the aperture of the top there are provided an upper permanently elastic resilient connecting and sealing element, to serve as connecting and sealing element, as well as a lower permanently elastic resilient connecting and sealing element being provided. The elements comprise prefabricated rings which need to be mounted during assembly and this makes installation cumbersome.

German Patent No. 41 33 409 C2 (corresponding to U.S. Pat. No. 5,313,929) further describes how a permanently elastic resilient connecting and sealing element can be glued to the edge portion of the aperture and to the gas burner. In this arrangement, this sealing element may be configured per se of a glued portion which is annular in shape, permanently elastic in characteristic, and configured to be disposed between the peripheral portion of the aperture and a connecting surface of the gas burner. This permanently elastic glued layer can then be configured with such a thickness that it is fluid-tight, on the one hand, and resilient, on the other hand. The arrangement has the disadvantage that the glued portion needs to be provided during mounting of the burners to the glass-ceramic plate. Gluing is a disadvantage in maintenance work since the gas burner can only be removed with difficulty and the gas burner subsequently can not be located tightly at the plate.

In German Patent No. 44 42 572 C1 (corresponding to U.S. Pat. No. 5,813,395) a further arrangement is described, of the protection of the peripheral portions of apertures in formed bodies of glass-ceramic, glass or ceramic. In this arrangement, a metallic cover or fitting is provided which extends over the peripheral portion of the aperture of the form body. Such a device comprises an additional part of the assembly.

German Patent No. 28 19 118 C2 (corresponding to U.S. Pat. No. 4,492,217) describes the gluing of a glass plate, or a glass-ceramic plate, to a frame. A pertinent glue comprises a silicon mass.

In a pamphlet of the firm HEIDELBERGER BAUCHEMIE GmbH, D-83291, Traunreut, a mono-component silicon mass having the trade name PACTAN is described and which is suitable for gluing and sealing. Depending on the requirements and the application situation, silicon masses with varying temperature stabilities can be employed. Standard silicone mass has a continuous use temperature of 180 degrees Celsius. High-temperature silicone mass can be continuously subjected to 260 degrees Celsius and for short periods of time to approximately 300 degrees Celsius.

The sealed arrangement of gas burners at a glass-ceramic plate is also known from U.S. Pat. No. 5,046,477. As is the case with German Patent No. 41 33 409 C2 (corresponding to U.S. Pat. No. 5,313,929), prefabricated seal rings are used.

OBJECT OF THE INVENTION

It is an object of the invention to provide a kitchen gas cooking stove with a glass-ceramic, glass, or ceramic top, a gas cooktop with a glass-ceramic, glass, or ceramic top, and a glass-ceramic, glass, or ceramic top of a cooking stove or a cooktop with a venting structure thereon.

Further, it is an object of one aspect of the invention to propose an arrangement of the type mentioned in the foregoing which avoids contact of the component-part with the plate and which achieves, in simple manner, to seal the component-part at the plate and the component-part is easily assembled and disassembled at the plate.

SUMMARY OF THE INVENTION

The invention teaches, in one embodiment, a kitchen cooking stove for preparing food, such as, cooking frying, roasting, sauteing, and boiling food, said stove comprising: a stove body; said stove body being configured with a support to support said stove body; said stove body being configured with a cook top to prepare food; said cook top comprising a portion; said portion comprising a glass-ceramic flat top; said glass-ceramic flat top having a first, upper, surface and a second, lower, surface, opposite said first surface; at least one cutout portion extending between said first surface and said second surface; at least one gas burner arrangement; said at least one gas burner arrangement being disposed adjacent to said at least one cutout portion; said at least one gas burner arrangement comprising a head portion being configured to emit and combust a flow of gas; at least one gas burner configuration comprising a cooking utensil receiving apparatus; said cooking utensil receiving apparatus being configured to receive a bottom of a cooking utensil to be heated by said at least one gas burner arrangement; said at least one gas burner arrangement being disposed at least with a portion thereof adjacent to said at least one cutout portion; said portion of said at least one gas burner arrangement adjacent to said at least one cutout portion comprising a support portion; apparatus to conduct a gas to said head portion of said at least one gas burner arrangement; apparatus to control a flow of gas to said at least one gas burner arrangement; a brushed on or sprayed on elastomeric silicone body securely bonded to said support portion of said at least one gas burner arrangement; said elastomeric silicone body comprising a silicone; said silicone being configured with a sufficient heat resistance to withstand heat produced by said at least one gas burner arrangement; said elastomeric silicone body being securely bonded to said support portion and configured to remain firmly attached to said support portion upon said at least one gas burner arrangement being removed from said glass-ceramic flat top; said elastomeric silicone body being configured and disposed to prevent contact between said at least one cutout portion and said support portion by maintaining a separation between said at least one gas burner arrangement and said glass-ceramic flat top and thus to prevent contact between said at least one gas burner arrangement and said glass-ceramic flat top; said elastomeric silicone body being configured and disposed to seal said at least one cutout portion and thus minimize cooking spills spilling on said glass-ceramic flat top from seeping along said elastomeric silicone body toward said cutout portion; at least a portion of said elastomeric silicone body being disposed in contact with said glass-ceramic flat top and being configured to be releasable from said glass-ceramic flat top; said bonded elastomeric silicone body being configured to be removed, together with said at least one gas burner arrangement, with minimized damage to said elastomeric silicone body, upon removal of said at least one gas burner from said glass-ceramic flat top.

In accordance with another feature of the invention there is provided a cooktop for preparing food; said cooktop comprising: a top portion; said top portion comprising a top; said top comprising at least one of: a glass-ceramic top, a glass top, and a ceramic top; said top having a first, upper, surface and a second, lower, surface, opposite said first surface; at least one cutout portion extending between said first surface and said second surface; at least one gas burner arrangement; said at least one gas burner arrangement being disposed adjacent to said cutout portion; said at least one gas burner arrangement comprising a head portion being configured to emit and combust a flow of gas; at least one gas burner configuration comprising a cooking utensil receiving apparatus; said cooking utensil receiving apparatus being configured to receive a bottom of a cooking utensil to be heated by said at least one gas burner arrangement; said at least one gas burner arrangement being disposed at least with a portion thereof adjacent to said at least one cutout portion; said portion of said at least one gas burner arrangement adjacent to said cutout portion comprising a support portion; apparatus to conduct a gas to said head portion of said at least one gas burner arrangement; apparatus to control a flow of gas to said at least one gas burner arrangement; a brushed on or sprayed on elastomeric silicone body securely attached to said support portion of said at least one gas burner arrangement; said elastomeric silicone body comprising a silicone; said silicone being configured with a sufficient heat resistance to withstand heat produced by said at least one gas burner arrangement; said elastomeric silicone body being securely attached to said support portion and configured to remain firmly attached to said support portion upon said at least one gas burner arrangement being lifted from said top; said elastomeric silicone body being configured and disposed to prevent contact between said at least one cutout portion and said support portion by maintaining a separation between said at least one gas burner arrangement and said top and thus to prevent contact between said at least one gas burner arrangement and said top; said elastomeric silicone body being configured and disposed to seal said at least one cutout portion and thus minimize cooking spills spilling on said top from seeping along said elastomeric silicone body toward said cutout portion; at least a portion of said elastomeric silicone body being disposed in contact with said top and being configured to be releasable from said top; said attached elastomeric silicone body being configured to be lifted, together with said at least one gas burner arrangement, with minimized damage to said elastomeric silicone body, upon lifting of said at least one gas burner from said top.

In accordance with another feature of the invention there is provided an appliance, such as, a cooking stove, a gas cooking stove, a cooktop, and a gas cooktop, said appliance comprising: a top portion; said top portion comprising a top; said top comprising at least one of: a glass-ceramic top, a glass top, and a ceramic top; said top having a first, upper, surface and a second, lower, surface, opposite said first surface; a cutout portion extending between said first surface and said second surface; a component-part comprising one of: a gas burner arrangement and a venting structure; and a brushed on or sprayed on elastomeric silicone body securely attached to one of (a.), (b.), and (c.): (a.) said cutout portion with said elastomeric silicon body attached thereto to provide a structure receiving and mounting said component-part on said top; at least a portion of said attached elastomeric silicone body being configured to remain firmly attached at said cutout portion upon displacement of said component-part from said top; (b.) said gas burner arrangement, with said elastomeric silicone body attached thereto, being disposed on said top, a portion of said gas burner arrangement being disposed within said cutout portion; said attached elastomeric silicone body being configured to remain firmly attached to said gas burner arrangement upon said gas burner arrangement being displaced from said top; at least a portion of said attached elastomeric silicone body being disposed in contact with said top and being configured to be releasable from said top upon displacement of said gas burner arrangement from said top; said attached elastomeric silicone body being configured to be displaced, together with said gas burner arrangement, with minimized damage to said attached elastomeric silicone body, upon displacement of said gas burner arrangement from said top; and (c.) said venting structure, with said elastomeric silicone body attached thereto, being disposed on said top, a portion of said venting structure being disposed within said cutout portion; said attached elastomeric silicone body being configured to remain firmly attached to said venting structure upon said venting structure being displaced from said top; at least a portion of said attached elastomeric silicone body being disposed in contact with said top and being configured to be releasable from said top upon displacement of said venting structure from said top; said attached elastomeric silicone body being configured to be displaced, together with said at least one venting structure, with minimized damage to said attached elastomeric silicone body, upon displacement of said venting structure from said top; said elastomeric silicone body comprising a silicone; said silicone being configured with a sufficient heat resistance to withstand heat produced by said appliance; said elastomeric silicone body being configured and disposed to prevent contact between said cutout portion and its corresponding component-part by maintaining a separation between its corresponding component-part and said top and thus to prevent contact between its corresponding component-part and said top; said elastomeric silicone body being configured and disposed to seal said cutout portion and thus minimize cooking spills spilling on said top from seeping along said elastomeric silicone body toward said cutout portion.

The silicone mass can be applied in simple manner in paste-like condition to the portion of the plate in question or of the component-part, by customary methods, such as, for example, by spraying or painting. The silicone mass is then chemically cross-linked under the influence of oxygen contained in air and provides a permanently elastic layer which is resistive to the operating temperature.

The silicone mass can be provided, as a function of the prevailing geometry of the aperture, or the recess, or the component-part, in aimed manner at such locations at which the component-part, upon installation, could contact the plate and at which a seal is required. The use of the silicone mass obviates the design and manufacture of special seal elements adapted to the geometry of the plate and the component-part. The use of the silicone mass further obviates the furnishing and assembly of prefabricated seal elements.

The silicone mass, in its role as layer against contact, ensures that the component-part does not directly contact the plate. Thus, it prevents damage to the plate.

The silicone mass, in its role as seal layer, seals a gap between the component-part and the plate in such a way that fluid reaching the plate does not flow into the gap. This is of particular importance in the case of cooking stoves.

The assembly of the component-part at the plate is simple. In the case where the component-part has the layer, the component-part at its layer is positioned at the aperture, or at the recess. In the case where the plate carries the layer, the component-part is positioned onto the layer.

Depending on the application location the silicone layer adheres at the plate or at the component-part. However, it does not glue the component-part to the plate because of being chemically cross-linked prior to assembly of the component-part to the plate and, accordingly, is only joined to the component-part or the plate. This permits a simple disassembly of the component-part and re-assembly while safeguarding the functioning of the layer. Upon releasing of mechanical clamping means, which hold the component-part at the plate, the component-part can be elevated without destruction of the layer. Subsequently, the component-part can be re-assembled to the plate whereupon the layer again provides the contact protection and the seal.

The above-discussed embodiments of the present invention will be described further hereinbelow. When the word "invention" is used in this specification, the word "invention" includes "inventions", that is the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The various embodiments of the invention are explained in greater detail below with reference to the exemplary embodiments which are illustrated in the accompanying drawings, in which.

DESCRIPTION OF THE PREFERRED EMBODIMENT

Figure 1:
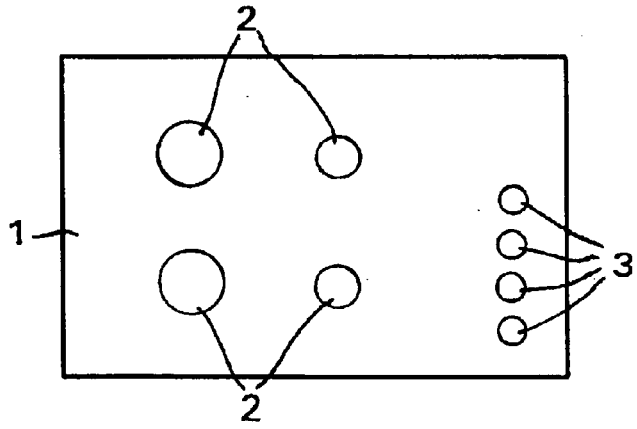
FIGS. 1 to 4: illustrate various embodiments of apertures in a glass plate or glass-ceramic plate of a cooking stove in plan view, for mounting of gas burners, operating knobs or elements, vapor removal or gas vents, as well as air introduction and air removal structures.
Figure 1A:
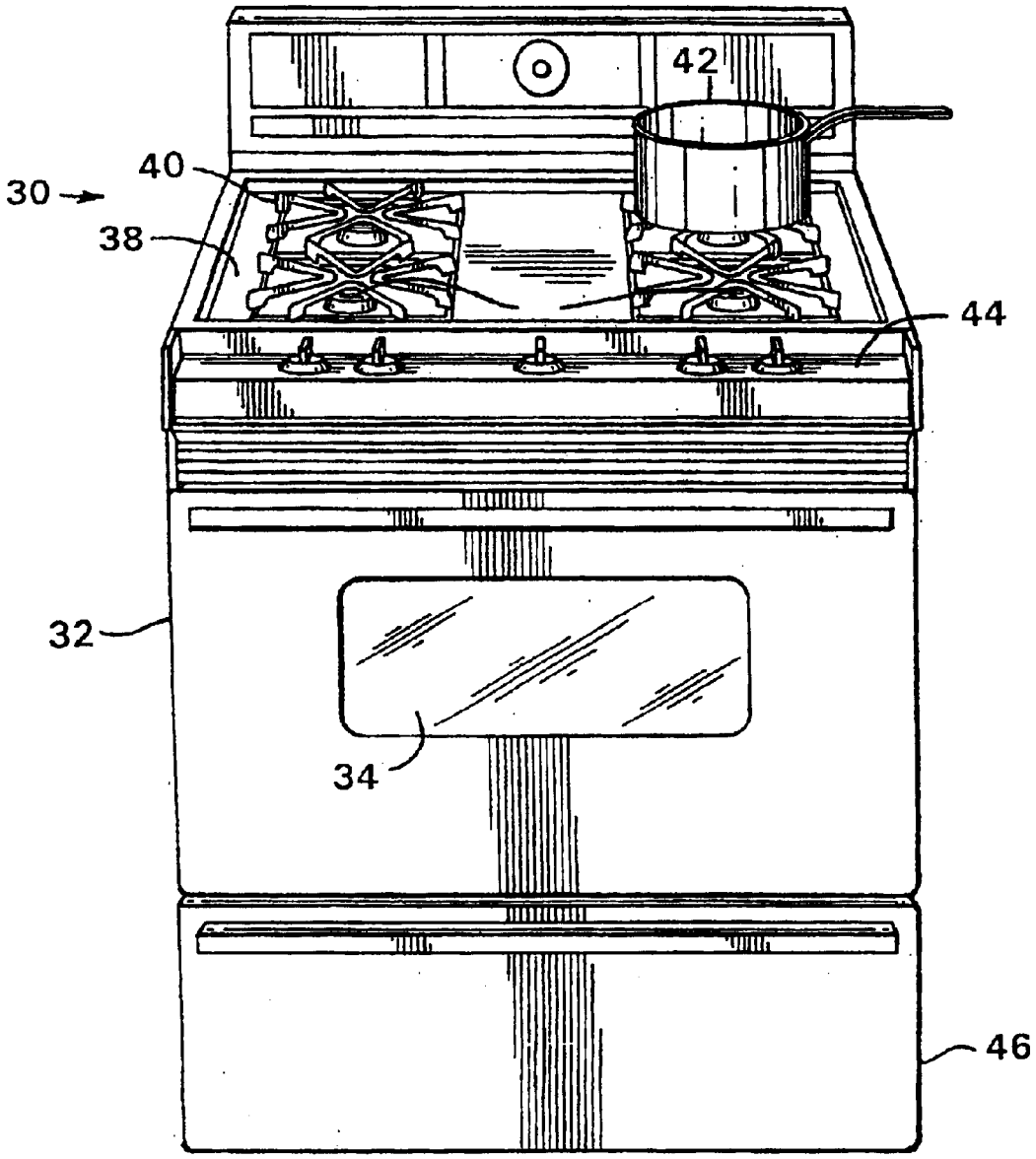
FIG. 1A PRIOR ART
FIG. 1A: is a perspective front view of a gas stove.

FIG. 1A is an illustration of a typical freestanding gas range or stove or appliance, generally identified by reference numeral 30. Stove 30 has cabinet 32 in which an oven 34 is housed. Also, four surface gas burners 36 are mounted to extend through and above main top 38. Grates 40 are seated on main top 38 to support cooking utensils 42 above surface burners 36. Control panel 44 is used to control oven 34 and surface burners 36. The stove has a base 46.

FIG. 1A is a copy of FIG. 1 from U.S. Pat. No. 5,405,263 issued to Gerdes, et al. on Apr. 11, 1995 and entitled, "Sealed gas burner assembly", from which figure copy all of the reference numerals present in the original figure, as it appears in U.S. Pat. No. 5,405,263, have been removed. U.S. Pat. No. 5,405,263 is hereby incorporated by reference as if set forth in its entirety. The reference numerals that have been removed from the figure for this U.S. Pat. No. 5,405,263 and changed to suit the present disclosure, indicate arrangements that are well known in the prior art.

Figure 1B:
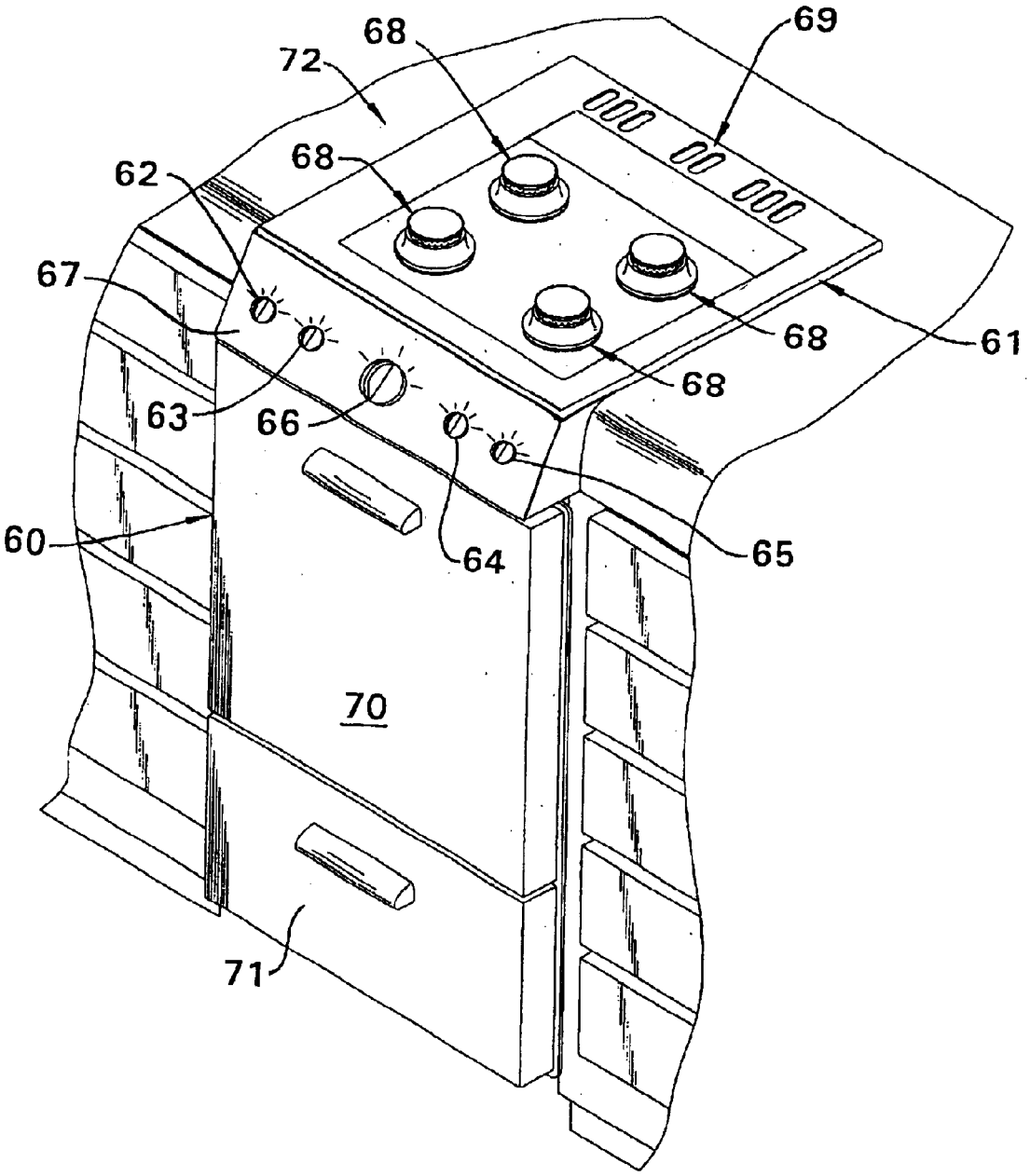
FIG. 1B PRIOR ART
FIG. 1B: is a perspective view of a built-in range with a cooktop.

With reference to FIG. 1B, a gas cooking appliance is disposed in a countertop arrangement 72. The appliance includes a cabinet 60 including a cooktop 61. In the embodiment depicted, cooktop 61 has four gas burner arrangements 68 and a provision for air inlets 69. Atop gas burners 68 one or more grates (not shown) can be disposed. Cooktop 61 leads to a front panel portion 67 that is preferably angled downwardly and forwardly. Front panel portion 67 has mounted thereto a plurality of control knobs 62, 63, 64, and 65 for regulating the operation of gas burner units 68 respectively. Front panel portion 67 also has provided thereon a central control knob 66 that is used to actuate one or more heating elements (not shown) associated with an oven cavity (not shown). In a manner known in the art, the oven cavity has associated therewith a door 70 which is pivotal between opened and closed positions for permitting access into and closing off the oven cavity respectively. As clearly shown in FIG. 1B for the sake of completeness, the appliance is shown to include a slidable pan or bin 71 that extends below the oven cavity 38.

FIG. 1B is a copy of FIG. 1 from U.S. Pat. No. 6,234,161 issued to Levi, et al. on May 22, 2001 and entitled, "Gas cooking appliance with isolated combustion and cooling air flows," from which figure copy all of the reference numerals present in the original figure, as it appears in U.S. Pat. No. 6,234,161 have been removed. U.S. Pat. No. 6,234,161 is hereby incorporated by reference as if set forth in its entirety. The reference numerals that have been removed from the figure for this U.S. Pat. No. 6,234,161 and changed to suit one aspect of the present invention, indicate arrangements that are well known in the prior art.

Figure 1C:
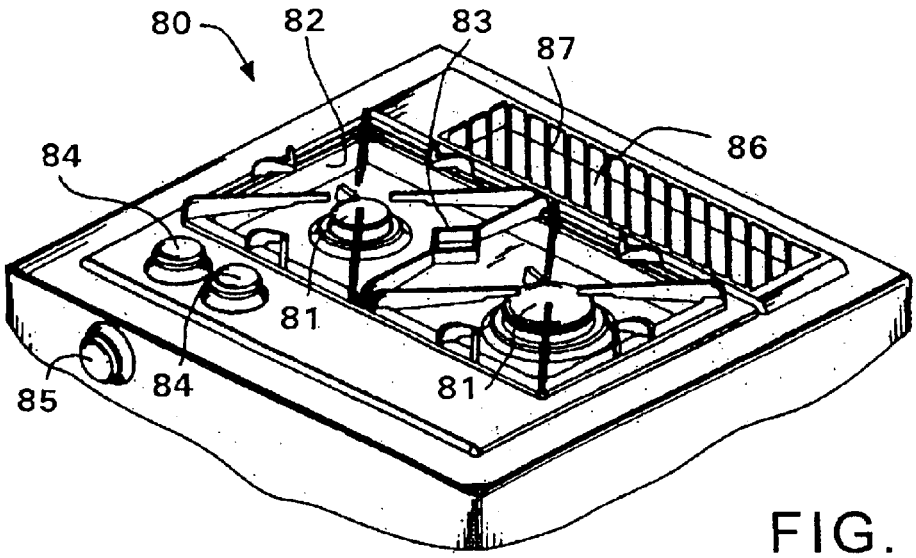
FIG. 1C PRIOR ART
FIG. 1C: is a perspective view of a gas fueled cooktop appliance.

FIG. 1C illustrates a gas cooktop appliance for use with a downdraft ventilating system. Thus, there is shown a gas fueled cooking appliance in the form of a modular cooktop designated generally 80 comprising a cooktop surface mounted from a supporting countertop. The cooktop 80 includes a pair of gas surface heating units 81 disposed in a generally rectangular depression 82 formed in the cooktop surface to contain spills. A removable grate 83 is provided to support cooking utensils over the heating units 81. Control knobs 84 for heating units 81 enable the user to turn the units on and off and adjust the heat settings.

In the configuration of FIG. 1C, a modular downdraft venting system is installed in the countertop adjacent to and extending along the rear edge of the cooktop 80. The air intake means for the downdraft system comprises a generally rectangular air inlet opening 86 covered by an air inlet grate 87. Operation of a downdraft blower motor (not shown) may be controlled by control knob 85.

In the illustrative embodiment herein described, the heating units 81 comprise so-called sealed gas burners, of the type commercially available from Sourdillon Airindex, SA, identified by the model numbers 51933 and 51932, respectively. The heating units 81 may be rated at 6,000 BTU/hour and at 10,500 BTU/hour. It will be appreciated that the details of the particular heating units herein described are provided for illustrative purposes and the size and number of heating units incorporated in the cooktop appliance 80 are not intended to be nor should they be construed as limitations.

FIG. 1C is a copy of FIG. 1 from U.S. Pat. No. 5,119,802 issued to Cherry, et al. on Jun. 9, 1992 and entitled, "Gas cooktop appliance for use with downdraft ventilation system," from which figure copy all of the reference numerals present in the original figure, as it appears in U.S. Pat. No. 5,119,802 have been removed. U.S. Pat. No. 5,119,802 is hereby incorporated by reference as if set forth in its entirety. The reference numerals that have been removed from the figure for this U.S. Pat. No. 5,119,802 and changed to suit one aspect of the present invention, indicate arrangements that are well known in the prior art.

Figure 1D:
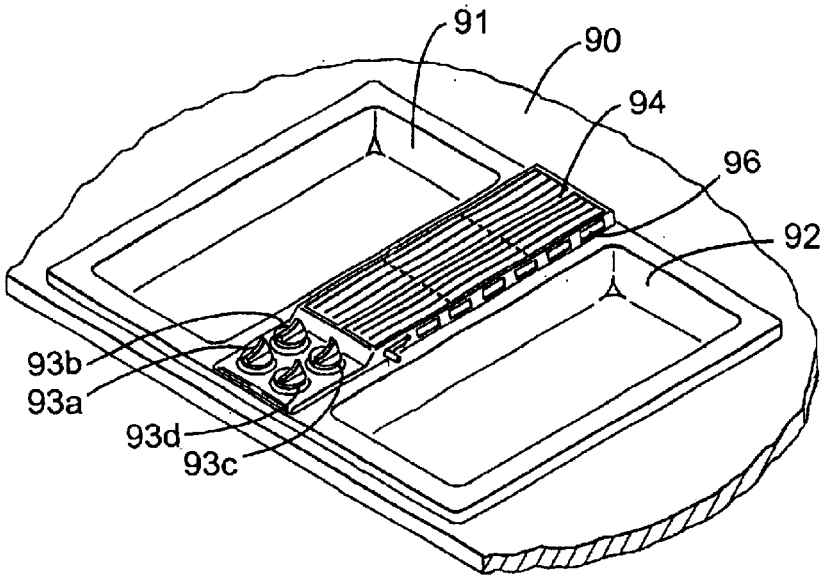
FIG. 1D PRIOR ART
FIG. 1D: is a perspective view of a venting structure for a cooktop appliance.

FIG. 1D shows a perspective view of a range with gas burner elements (not shown) with reference numeral 90 designating the upper surface of a range (either a free-standing range or counter drop-in type) provided with pan-like sheet metal recess means or pans 91 and 92 for selectively receiving cooking apparatus of various types. Control of the burner arrangements is by way of controls 93*a*, 93*b*, 93*c*, and 93*d*. A grille or venting structure 94 having openings 96 is provided centrally on range 90.

FIG. 1D is a copy of FIG. 1 from U.S. Pat. No. 4,431,892 issued to White on Feb. 14, 1984 and entitled, "Ventilated modular cooktop cartridge", from which figure copy all of the reference numerals present in the original figure, as it appears in U.S. Pat. No. 4,431,892 have been removed. U.S. Pat. No. 4,431,892 is hereby incorporated by reference as if set forth in its entirety. The reference numerals that have been removed from the figure for this U.S. Pat. No. 4,131,892 and changed to suit one aspect of the present invention, indicate arrangements that are well known in the prior art.

Figure 1E:
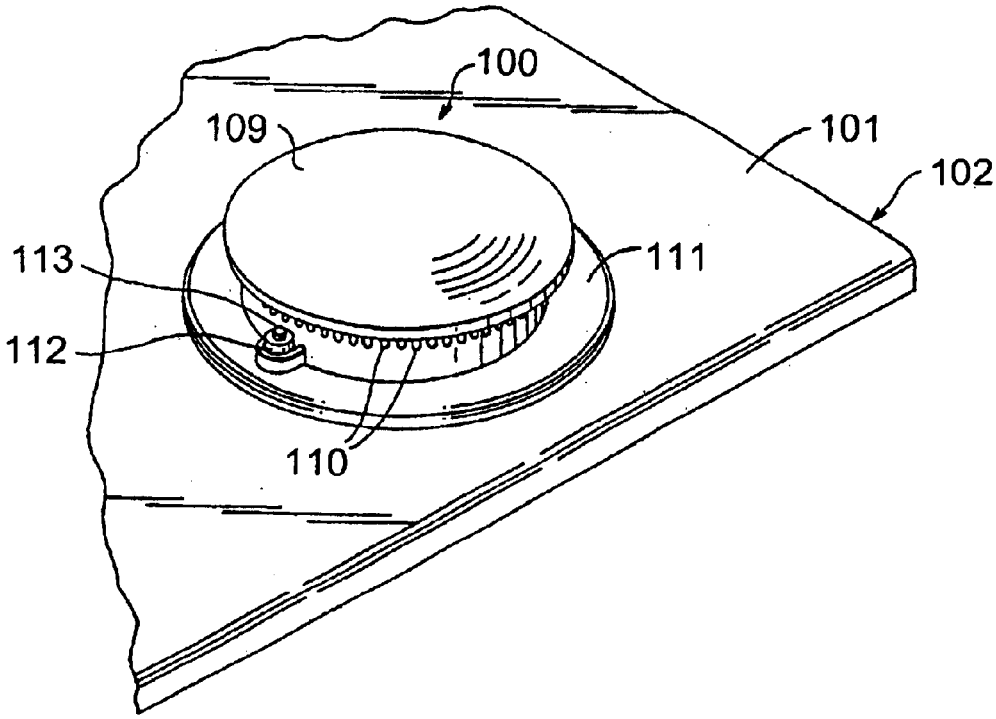
FIG. 1E PRIOR ART
FIG. 1E: is a perspective view of a gas burner head.

FIG. 1E illustrates a gas burner head. Thus, the burner construction is generally indicated by the reference numeral 100 and is illustrated as being sealed to a range top surface 101 of a cooking apparatus that is generally indicated by the reference numeral 102. The annular flange 111 of the body means 109 can be provided with a suitable opening passing therethrough and receiving an electrode assembly 112 for sparking from an electrode 113 thereof to the burner construction 100 and thereby igniting fuel issuing out of the port means 110 adjacent thereto in a manner well known in the art.

FIG. 1E is a copy of FIG. 1 from U.S. Pat. No. 5,002,038 issued to Riehl on Mar. 26, 1991 and entitled, "Burner construction and method of making the same", from which figure copy all of the reference numerals present in the original figure, as it appears in U.S. Pat. No. 5,002,038 have been removed. U.S. Pat. No. 5,002,038 is hereby incorporated by reference as if set forth in its entirety. The reference numerals that have been removed from the figure for this U.S. Pat. No. 5,002,038 and changed to suit one aspect of the present invention, indicate arrangements that are well known in the prior art.

Turning to FIG. 1, a glass-ceramic plate 1 for a cooking stove, particularly a domestic cooking stove, has apertures. In the embodiment according to FIG. 1, four apertures or orifices 2 for mounting of gas burners associated with cooking locations are provided; and four apertures or orifices 3 for mounting of the associated operating elements are provided.

Figure 2:
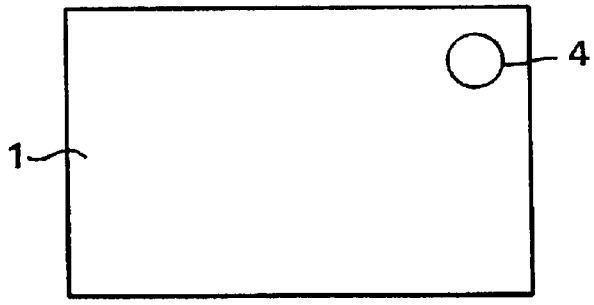

In the embodiment according to FIG. 2, an aperture 4 which serves to remove cooking vapors from a backing or broiling compartment of the cooking stove is shown. Again, the plate according to FIG. 2 can comprise apertures 2 for the mounting of gas burners. In the case where the cooking stove has a cooking location which can be heated electrically or with gas in radiant manner, the apertures 2 are not provided.

Figure 3:
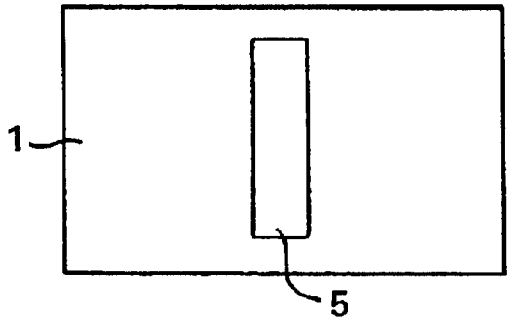

In the embodiment according to FIG. 3, the plate 1 has an aperture 5, which is disposed between the cooking location of the plate 1. The aperture 5 serves to mount a component-part that aspirates vapor by means of a ventilator, namely, vapors from cooking pots which are disposed on the cooking locations.

Figure 4:
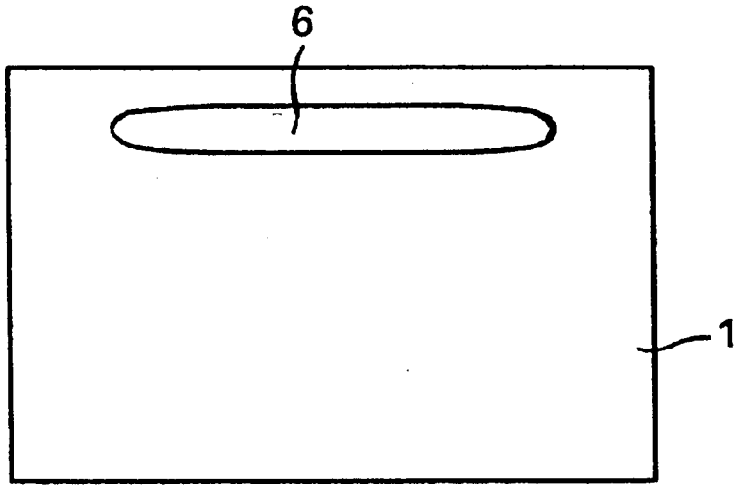

In the case of the plate according to FIG. 4, an aperture 6 for mounting of a component-part, for example, an aeration lattice or screen which is passing fresh air to gas burners disposed beneath the plate 1 and/or removes off-gas from these gas burners is provided.

Figure 5:
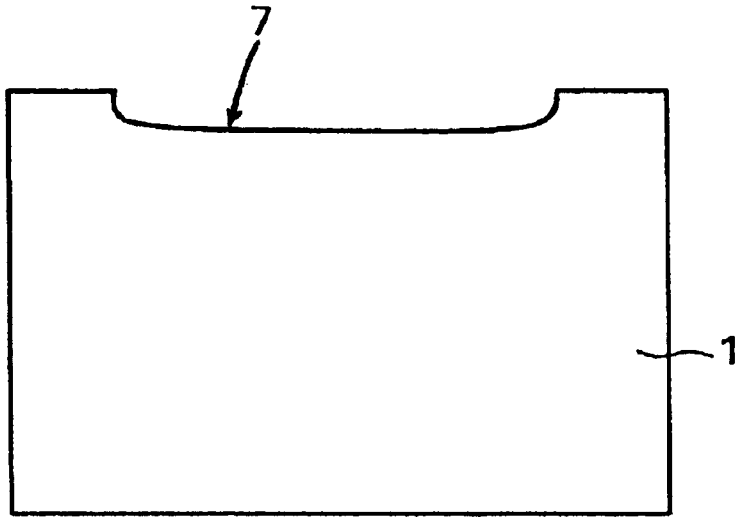
FIG. 5: a glass plate or glass-ceramic plate with an aperture for air introduction or air removal.

The plate in accordance with FIG. 5 has a recess 7 at which the component-part is to be mounted which component-part has the same function as the component-part mentioned in reference to FIG. 4.

Component-parts to be mounted at the plate 1, such as, gas burners, vapor removal apparatus, or venting screens, are customarily made of metal or comprise metal at least in the attachment region so as to withstand the temperatures arising at the plate 1.

The component parts must not touch the plate 1 and any gaps present between the component-parts and the plate 1 must be sealed in such a way that fluids escaping from cooking pots do not escape under the plate 1.

In order to provide both, a protection against contact and a seal, a layer or body 8 is configured in the peripheral portion of the apertures 2 to 6 and/or the recess 7, by spraying or painting, which layer is provided by a silicone mass of adequate temperature stability (in US customary language: a RTV [room temperature vulcanized] mass). Such a silicone mass comprises, for example, the product having the trade name PACTAN mentioned in the foregoing. The silicone mass is employed in the embodiments in such a way that the layer does not glue the component-part to the plate.

Figure 6:
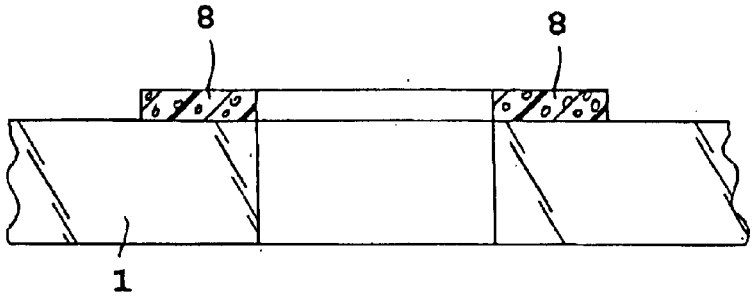
FIGS. 6 to 8: illustrate cross-sections of the plate in the region of an aperture with different layer configurations.
Figure 7:
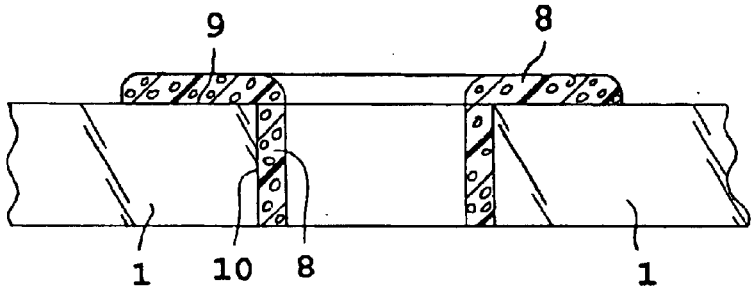
Figure 8:
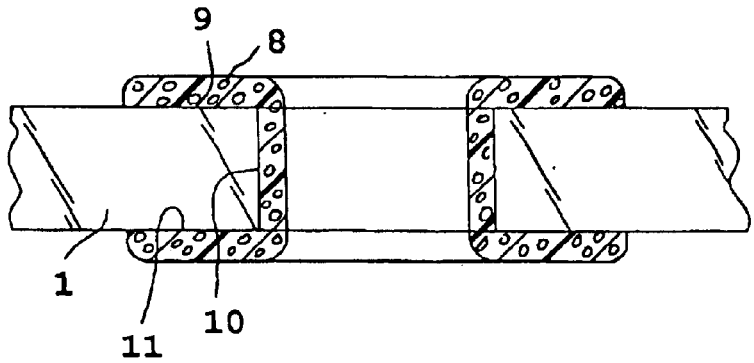

In the embodiment examples in accordance with FIGS. 6, 7, and 8, the silicone layer 8 is applied in the peripheral portion of the apertures 2 to 6, and/or the recess 7. In accordance with FIG. 6, the silicone layer 8 is applied to the upper edge 9 of the respective aperture of the plate 1. In accordance with FIG. 7, the silicone layer 8 is applied to the upper edge and the inner edge 10 of the respective apertures. In accordance with FIG. 8, the silicone layer 8,is applied to the upper edge 9 and the inner edge 10, and to the lower edge 11 of the respective aperture 2 to 6 and/or the recess 7.

The silicone mass or body 8 is applied in its paste-like condition, for example, by spraying or painting. So as to delimit a possibly necessary defined outer contour, or an inner contour, the respective regions not to be covered by the silicone mass can thereby be covered with a mask or a template. Next, chemical cross-linking is effectuated, prior to mounting of the respective component-part, so as to preclude the danger of a glued joining. The component-part is held at the plate 1 by means of known mechanical clamps.

Figure 9:
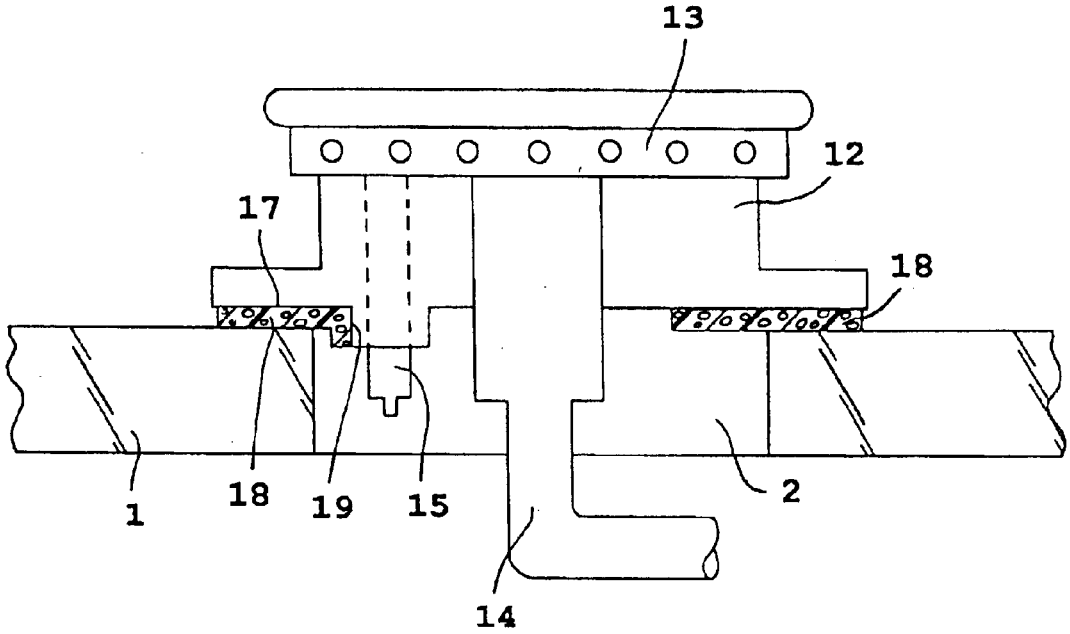
FIGS. 9 and 10: illustrate various arrangements of a gas burner at the plate.
Figure 10:
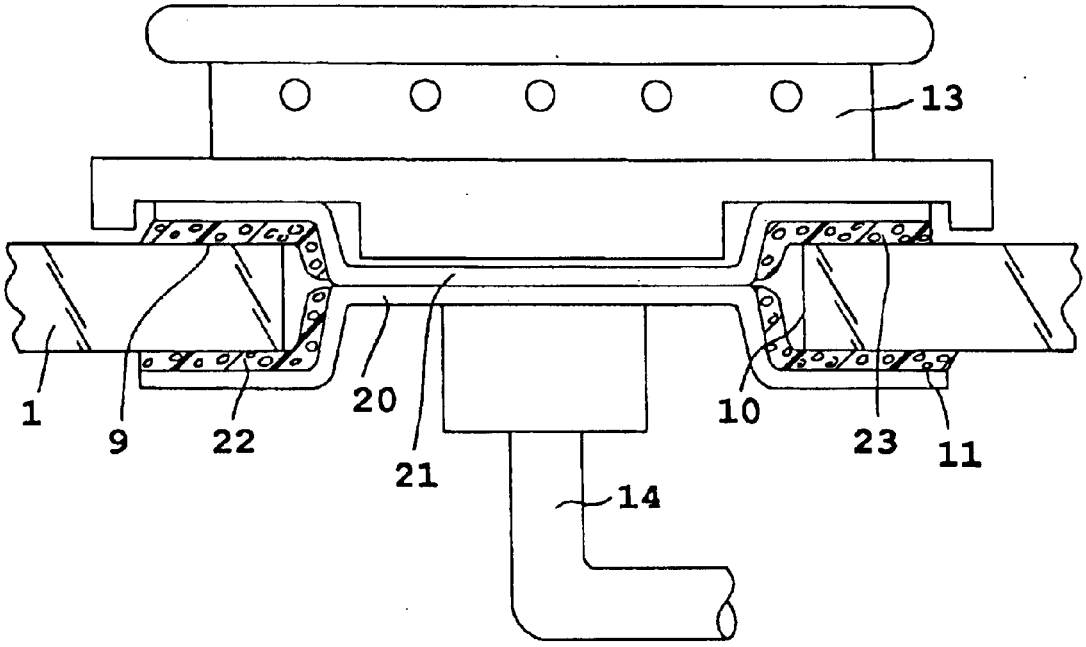

FIG. 9 illustrates a gas burner 12 as component-part, which burner is to be secured at one of the apertures 2. The gas burner 12 comprises a burner head 13, a gas admitting duct 14, and, in customary manner, one or several securement bases 15 for an ignition plug, and/or a thermal element.

In the event that the silicone layer 8, in accordance with FIGS. 6 to 8, is prefabricated, the gas burner 12 does not require its own silicone layer in order to prevent contact between it, the burner, and the plate 1 and to sealingly close a gap 16 which exists between the burner and the plate 1.

FIG. 9 shows an alternate configuration of the application of the silicone layer 8 at the plate 1. In accordance with FIG. 9, the silicone mass is applied on the peripheral region 17 of the gas burner 12 which peripheral region surrounds the gas burner, the application of the silicone mass being, for example, by spraying or brushing or painting. The layer is chemically cross-linked prior to assembly of the component-part to the plate and configures the layer 18. The layer 18 is provided at all those locations where contact could possibly arise between the gas burner 12, during assembly and during operation, with the plate 1. Correspondingly, the layer 18 is also provided in the region 19 of the fastening base 15 (compare FIG. 9).

In the embodiment in accordance with FIG. 9, for the arrangement of the gas burner 12 at the plate 1, as component-part, a pair of profiled metallic fastening sheets 20, 21 is provided. These sheets carry interior layers 22, 23 of the silicone mass and particularly in such a way that respectively the upper edge 9, the inner edge 10, and the lower edge 11 of the respective aperture, or of the recess, is protected against contact. The fastening sheets 20 and 21 are held by means of screw connections, or the like, at the plate 1. The burner head 13 is releasably positioned on the fastening sheets 20, 21.

In all embodiment examples, the layer or body created by the silicone mass is covered in such a manner that the user of the cooking stove does not perceive or barely perceives the layer. The component-part covers the layer.

Figure 11:
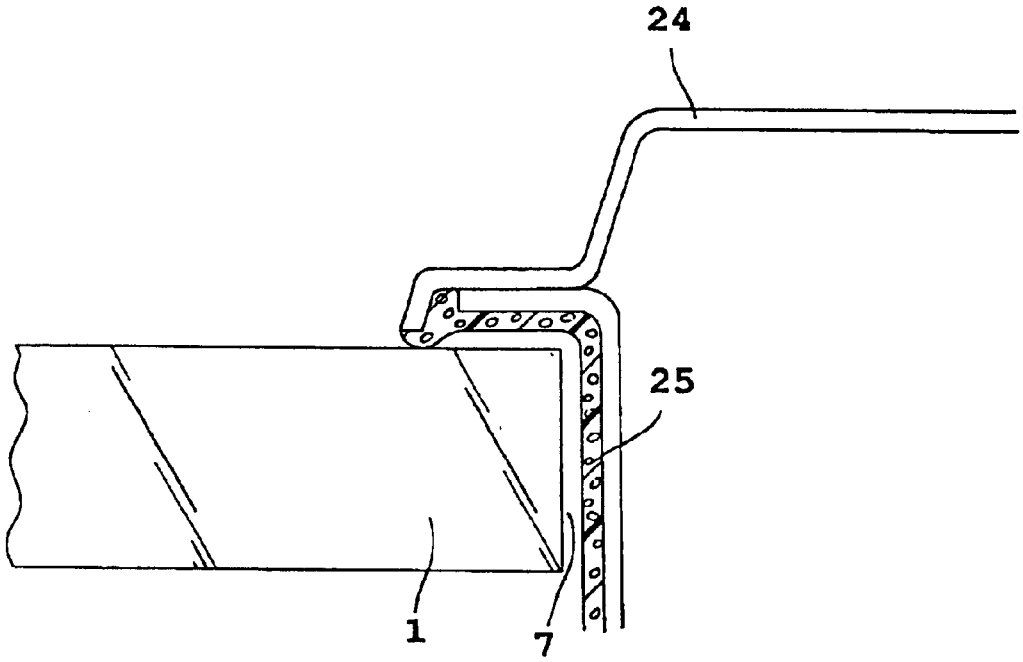
FIG. 11: illustrates schematically the air introduction and/or the air removal at a glass plate or at a glass-ceramic plate.

FIG. 11 illustrates, as a component-part that needs to be provided at the apertures 4, 5, and 6, or the recess 7, of the plate 1, a metallic venting screen 24. At this screen is applied a layer 25 of the mentioned silicone mass at locations at which the component-part could otherwise contact the plate 1; and at locations at which fluids could possibly enter.

In the instance of maintenance or repair of the cooking stove, the component-part is readily removed from the plate 1, since it is not glued to the plate. Upon re-assembly of the component-part at the plate, the layer 8, 18, 22, 23, 25, which remains undamaged during disassembly, again affords its function as contact protection and fluid seal.

One feature of the invention resides broadly in an arrangement comprising a plate of glass-ceramic, glass, or ceramic, and comprising a component-part, particularly of metal, arranged at an aperture or recess of the plate characterized thereby that a silicone mass is applied on the plate (1), or on the component-part (12, 20, 21, 24) in the edge portion of the aperture (2, 3, 4, 5, 6), or the recess (7), the silicone mass forms a layer that prevents contact and a layer that provides a seal, and that the component part is connected with the plate in non-glued manner.

Another feature of invention resides broadly in an arrangement characterized thereby that the silicone mass (8, 18, 22, 23, 25) is covered by the component part (12, 20, 21, 24).

Yet another feature of the invention resides broadly in an arrangement characterized thereby that the silicone mass (8, 18, 22, 23, 25) is provided at the upper edge (9) and/or the lower edge (11) and/or the inner edge (10) of the aperture (2 to 6) of the recess (7).

Still another feature of the invention resides broadly in an arrangement characterized thereby that the silicone mass (8, 18, 22, 23, 25) is arranged at the edge of a gas burner (12) or a venting screen (24).

A further feature of the invention resides broadly in an arrangement characterized thereby that the silicone mass (8, 18, 22, 23) is applied by spraying.

In at least one embodiment of the invention, the elastomeric silicone body is adhesively attached to the respective component. In at least one embodiment, the elastomeric silicone body is bonded to the respective component.

It will appreciated that a stove can include a cooktop.

The components disclosed in the various publications, disclosed or incorporated by reference herein, may be used in the embodiments of the present invention, as well as equivalents thereof.

It will be appreciated that the silicone body protects the adjacent portion of the glass-ceramic, or glass, or ceramic top from fractures during installation of and during removal of the associated component-part, such as, a gas burner arrangement, or a venting structure.

The combined height of fastening sheet or mounting structure 20 and the adjacent lip or flange of the elastomeric silicone body is sufficient to prevent cooking spills to enter the aperture or cutout portion 2.

The venting structure 24 may be for the introduction of air or like gas, or for the removal of vapors arising at a stove.

Thus, in one aspect, this invention relates to an arrangement comprising a plate of glass-ceramic, glass, or ceramic, and comprising a component-part, particularly of metal, that is arranged at an aperture, or orifice, or recess, of the plate.

Thus, in an arrangement comprising a plate of glass-ceramic, glass, or ceramic, and comprising a component-part arranged at an aperture or recess of the plate, any contact of the component-part 12 with the plate 1 is prevented. Additionally, a closing of a gap and a simple assembly are to be attained. For this, a silicone mass is applied to the plate 1, or to the component-part 12, in the peripheral region of the aperture or recess, which silicone mass configures a non-adhesive contact prevention layer and a seal layer.

Further, the stove may be an electric stove, or the like appliance, in which components, such as, a venting structure, need to be secured to be out of contact, but in sealed relationship.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The details in the patents, patent applications and publications incorporated herein by reference as if fully set forth herein may be considered to be incorporable, at Applicants' option, into the claims during prosecution as further limitations in the claims to patentably distinguish any amended claims from any applied prior art.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

The following patent applications and patent documents, assigned to the Assignee herein, and relating to cooking appliances, features of which may possibly be used or adapted for use in at least one embodiment of the invention, are hereby incorporated by reference as if set forth in their entirety herein: U.S. patent application Ser. No. 09/952,314, filed on Sep. 24, 2001, having inventor Torsten GABELMANN and having Attorney Docket No. NHL-FMW-08 US (SCT) having the title, "A gas stove for cooking food with at least one gas burner and a gas cooktop for cooking food with at least one gas burner;" U.S. Pat. No. 6,021,774, having attorney docket No. NHL-SCT-01 US, having inventors Taplan et al., issued on Feb. 8, 2000, entitled, "Cooking unit, such as a stove, for cooking food"; U.S. Pat. No. 6,148,812, having attorney docket No. NHL-SCT-01-C-US, having inventors Taplan et al., issued on Nov. 21, 2000, entitled, "Cooking unit, such as a stove, for cooking food"; U.S. Pat. No. 6,002,112, having attorney docket No. NHL-SCT-03 US, having inventors NAβ et al., issued on Dec. 14, 1999, entitled, "Cooking appliance, such as a stove with a glass-ceramic hob or cooktop with a rapid cooking ring or hotplate"; U.S. Pat. No. 6,111,229, having attorney docket No. SCT-04 US, having inventor Schultheis, issued on Aug. 29, 2000, entitled, "Cooking appliance such as a stove with an arrangement of a ceramic heating element as cooking zone in a cutout of a cooking surface"; U.S. Pat. No. 6,050,176, having attorney docket No. SCT-05 US, having inventors Schultheis et al., issued on Apr. 18, 2000, entitled, "Arrangement of a hotplate in a cooktop; and U.S. Pat. No. 6,236,024, having attorney docket No. NHL-SCT-09 US, having inventors Gotz et al., issued on May 22, 2001, entitled, "Cooktop or stove having an arrangement of a one-piece molded part made of glass-ceramic, glass or ceramic in the cooking surface area of the cooking unit in a cutout of a sill plate;" U.S. patent application Ser. No. 09/522,460, entitled, "Cooking unit, such as a stove, for cooking food," having attorney docket No. NHL-SCT-10 US, having inventors Dipl.-Ing. Michael MUSKALLA, Keramik-Ing. Werner HOTTUM, and Dipl.-Ing. Bernd SCHULTHEIS, filed on Mar. 9, 2000; U.S. patent application Ser. No. 09/758,953, entitled, "Stove or grill for cooking, and stove or grill for cooking having a glass-ceramic cooktop or hob, and a glass-ceramic plate cooktop or hob for use in a stove or grill," having attorney docket No. NHL-GAI-01 (SCT) US, having inventors Ioannis KOSMAS, Dietmar WENNEMANN, and Joachim GRUTZKE, filed on Jan. 11, 2001.

Some examples of stoves and ranges which may possibly be utilized or adapted for use in at least one possible embodiment of the present invention may be found in the following U.S. Pat. No. 4,431,892 issued to White on Feb. 14, 1984 and entitled, "Ventilated modular cooktop cartridge"; U.S. Pat. No. 4,569,328 issued to Shukla, et al. on Feb. 11, 1986 and entitled, "efficient, low emission gas range cooktop"; U.S. Pat. No. 4,899,723, issued to Pajares on Feb. 13, 1990 and entitled, "Combination gas and electric stove with burner arrangement therefor"; U.S. Pat. No. 5,119,802 issued to Cherry, et al. on Jun. 9, 1992 and entitled "Gas cooktop appliance for use with downdraft ventilation system"; No. 5,213,091 issued to Beach on May 25, 1993 and entitled, "Downdraft gas range with sealed burner system"; U.S. Pat. No. 5,377,660, issued to Bombardier on Jan. 3, 1995 and entitled, "Protective cover"; U.S. Pat. No. 5,400,765, issued to Goldstein, et al. on Mar. 28, 1995 and entitled, "Selective emissive cooking stove"; U.S. Pat. No. 5,400,766, issued to Dillon on Mar. 28, 1995 and entitled, "Gas appliance stove safety valve system"; No. D359,345, issued on Jun. 13, 1995; No. D361,015, issued on Aug. 8, 1995; U.S. Pat. No. 5,464,005, issued to Mizrahi on Nov. 7, 1995 and entitled, "Stove"; U.S. Pat. No. 5,780,817, issued to Eckman, et al. on Jul. 14, 1998 and entitled, "Retrofittable glass-top electric stove element"; U.S. Pat. No. 5,983,884 issued to Lee on Nov. 16, 1999 and entitled, "Modular gas appliance system"; U.S. Pat. No. 6,173,708 issued to Arntz, et al. on Jan. 16, 2001 and entitled, "Gas burner mounting assembly for appliance with ceramic based cooktop"; and U.S. Pat. No. 6,328,556 issued to Sömer on Dec. 11, 2001 and entitled, "Gas burner for stove". The aforementioned patents are hereby incorporated by reference as if set forth in their entirety herein.

Some examples of ceramic materials, glass, or glass-ceramic materials, features of which may possibly be utilized or adapted for use in the context of the present invention may be disclosed in the following U.S. Pat. No 3,941,117, issued to Pei, et al. on Mar. 2, 1976 and entitled, "Cooktop for a gas-fired range"; U.S. Pat. No. 3,987,275 issued to Hurko on Oct. 16, 1976 and entitled, "Glass plate surface heating unit with sheathed heater"; U.S. Pat. No. 4,002,883, issued to Hurko on Jan. 11, 1977 and entitled, "Glass-ceramic plate with multiple coil film heaters"; U.S. Pat. No. 4,851,372 issued to Lindig, et al. on Jul. 25, 1989 and entitled, "Glass-ceramic with specific thermal expansion behavior"; U.S. Pat. No. 5,070,045, issued to Comte, et al. on Dec. 3, 1991 and entitled, "Transparent glass-ceramic articles"; U.S. Pat. No. 5,138,135, issued to Husslein, et al. on Aug. 11, 1992 and entitled, "Cooktop"; U.S. Pat. No. 5,212,122, issued to Pannhorst, et al. on May 18, 1993 and entitled, "Transparent colored glass ceramic with good thermal stability and variable transmission in the IR range"; U.S. Pat. No. 5,422,318, issued to Hagg, et al. on Jun. 6, 1995 and entitled, "Glass-ceramic and color package"; U.S. Pat. No. 5,446,008, issued to Krolla, et al. on Aug. 29, 1995 and entitled, "Transparent or translucent inorganic material with high transmission in the 2700–3300 nm wavelength range"; and U.S. Pat. No. 5,958,272, issued to Taplan, et al. on Sep. 28, 1999 and entitled, "Cooktop with a glass or glass-ceramic cooking surface"; and U.S. Pat. No. 5,385,873, issued to MacNeill on Jan. 31, 1995 and entitled, "High temperature resistant material". The aforementioned patents are hereby incorporated by reference as if set forth in their entirety herein.

Some examples of burners and related components which may possibly be utilized or adapted for use in at least one possible embodiment of the present invention may be found in the following U.S. Pat. No. 4,348,571, issued to Dills on Sep. 7, 1982 and entitled, "Flux shaping arrangement for induction surface unit"; U.S. Pat. No. 4,758,710, issued to Crossley et al. on Jul. 19, 1988 and entitled, "Heating apparatus"; U.S. Pat. No. 5,160,256 issued to Riehl on Nov. 3, 1992 and entitled, "Burner construction, igniter assembly therefor and methods of making the same"; U.S. Pat. No. 5,186,158, issued to Ferlin on Feb. 16, 1993 and entitled, "Gas burner"; U.S. Pat. No. 5,329,918, issued to Di Bari on Jul. 19, 1994 and entitled, "Combined electric and gas burner"; U.S. Pat. No. 5,397,234, issued to Kwiatek on Mar. 14, 1995 and entitled "Gas stove top burner assembly;"; U.S. Pat. No. 5,400,765, issued to Goldstein et al. on Mar. 28, 1995 and entitled, "Selective emissive cooking stove"; U.S. Pat. No. 5,639,232 issued to Bogenschutz, et al. on Jun. 17, 1997 and entitled, "Gas burner"; U.S. Pat. No. 5,839,426, issued to Aretxaga on Nov. 24, 1998 and entitled, "Gas distribution box to stove burners"; U.S. Pat. No. 6,089,219, issued to Kodera, et al. on Jul. 18, 2000 and entitled, "Gas burner for cooking stove"; U.S. Pat. No. 6,253,761, issued to Shuler, et al. on Jul. 3, 2001 and entitled, "Sensing device for stoves"; and U.S. Pat. No. 6,280,180, issued to Fredin-Garcia-Jurado, et al. on Aug. 28, 2001 and entitled, "Method and system for igniting a burner of a gas stove". The aforementioned patents are hereby incorporated by reference as if set forth in their entirety herein.

The following U.S. Patents, also referred to above, are hereby incorporated by reference as if set forth in their entirety herein: U.S. Pat. No. 4,492,217 issued to Scheidler on Jan. 8, 1985 and entitled "Panel assembly, particularly a glass or vitreous ceramic heater or cooker panel assembly"; U.S. Pat. No. 5,046,477 issued to Bennett, et al. on Sep. 10, 1991 and entitled, "Gas Cook-top with glass top"; U.S. Pat. No. 5,313,929 issued to Thürk, et al. on May 24, 1994 and entitled "Arrangement of at least one gas burner in a molded part of a brittle-friable material for example for cooking units"; and U.S. Pat. No. 5,813,395 issued to Taplan, et al. on Sep. 29, 1998 and entitled "Device for protecting rims in glass or ceramic bodies".

Some examples of silicone elastomers which may possibly be used or adapted for use in at least one embodiment of the invention may be found in the following U.S. Pat. No. 3,133,891 issued to Ceyzariat on May 19, 1964 and entitled "Room temperature curable siloxane composition"; U.S. Pat. No. 4,247,445 issued to Smith, Jr., et al. on Jan. 27, 1981 and entitled "Paintable one-component RTV system"; U.S. Pat. No. 4,273,698 issued to Smith, Jr., et al. on Jun. 16, 1981 and entitled "Self-bonding room temperature vulcanizable silicone rubber compositions"; U.S. Pat. No. 4,304,897 issued to Bluestein on Dec. 8, 1981 and entitled "Room temperature vulcanizable silicone rubber compositions and process of making"; U.S. Pat. No. 4,461,867 issued to Suprenant on Jul. 24, 1984 and entitled "Composition for promoting adhesion of curable silicones to substrates"; U.S. Pat. No. 4,472,564 issued to Lockart on Sep. 18, 1984 and entitled "Method of making an enoxy stabilized room temperature vulcanizable organopolysiloxane composition which resists color change upon aging"; U.S. Pat. No. 4,489,199 issued to Wengrovius on Dec. 18, 1984 and entitled "Room temperature vulcanizable organopolysiloxane compositions"; U.S. Pat. No. 4,673,750 issued to Beers, et al. on Jun. 16, 1987 and entitled "Auto-adhering one-component RTV silicone sealant composition utilizing glycidoxylalkyl substituted alkoxy-oxime silane as an adhesion promoter"; U.S. Pat. No. 4,735,979 issued to Beers, et al. on Apr. 5, 1988 and entitled "Auto-adhering one-component RTV silicone sealant composition utilizing am adhesion promoter"; U.S. Pat. No. 4,892,907 issued to Lampe, et al. on Jan. 9, 1990 and entitled "Fast room temperature vulcanizing silicone elastomers"; U.S. Pat. No. 5,661,192 issued to Giraud on Aug. 26, 1997 and entitled "Organopolysiloxane composition for elastomer foam"; and U.S. Pat. No. 5,990,231 issued to De Groot, Jr., et al. on Nov. 23, 1999 and entitled "Room temperature vulcanizing silicone rubber compositions and process for making".

Some further examples of silicone elastomeric material, possibly relating to PACTAN, features of which may possibly be used in at least one embodiment of the invention may be found in the following U.S. Pat. No. 5,739,248 issued to Hoheneder on Apr. 14, 1998 and entitled "Composition for the production of rapidly hardening aminosilane cross-linking silicone masses"; and U.S. Pat. No. 6,020,389 issued to Hoheneder on Feb. 1, 2000 and entitled "Process for the foaming of acyloxysilane-containing silicone masses"; and in the following International Patent Publications: U.S. Pat. No. WO 00/05298 published on Feb. 3, 2000 and entitled "High-resistant condensation cross-linking silicon"; No. WO 00/05308 published on Feb. 3, 2000 and entitled "Accelerated acetate-hardening silicon materials"; and U.S. Pat. No. WO 00/05309 published on Feb. 3, 2000 and entitled "Quick hardening silicon materials with good adhesive properties". All of the foregoing patents and patent publications are hereby expressly incorporated by reference as if fully set forth in their entirety herein.

One feature of the invention resides broadly in a kitchen cooking stove for preparing food, such as, cooking frying, roasting, sauteing, and boiling food, said stove comprising:

a stove body (12);

said stove body being configured with a support (46) to support said stove body;

said stove body being configured with a cook top (38) to prepare food;

said cook top comprising a portion (1);

said portion comprising a glass-ceramic flat top (1);

said glass-ceramic flat top (1) having a first, upper, surface and a second, lower, surface, opposite said first surface;

at least one cutout portion (2) extending between said first surface and said second surface;

at least one gas burner arrangement (12);

said at least one gas burner arrangement (12) being disposed adjacent to said at least one cutout portion (2);

said at least one gas burner arrangement (12) comprising a head portion (13) being configured to emit and combust a flow of gas;

at least one gas burner configuration (40) comprising a cooking utensil receiving apparatus;

said cooking utensil receiving apparatus (40) being configured to receive a bottom of a cooking utensil (42) to be heated by said at least one gas burner arrangement (12);

said at least one gas burner arrangement (12) being disposed at least with a portion (15) thereof adjacent to said at least one cutout portion (2);

said portion (15) of said at least one gas burner arrangement (12) adjacent to said at least one cutout portion (2) comprising a support portion (15);

apparatus (14) to conduct a gas to said head portion (13) of said at least one gas burner arrangement (12);

apparatus to control (62-65) a flow of gas to said at least one gas burner arrangement (12);

a brushed on or sprayed on elastomeric silicone body (8, 18) securely bonded to said support portion (15) of said at least one gas burner arrangement (12);

said elastomeric silicone body (8, 18) comprising a silicone;

said silicone being configured with a sufficient heat resistance to withstand heat produced by said at least one gas burner arrangement (12);

said elastomeric silicone body (8, 18) being securely bonded to said support portion (15) and configured to remain firmly attached to said support portion (15) upon said at least one gas burner arrangement (12) being removed from said glass-ceramic flat top (1);

said elastomeric silicone body (8, 18) being configured and disposed to prevent contact between said at least one cutout portion and said support portion (15) by maintaining a separation between said at least one gas burner arrangement (12) and said glass-ceramic flat top (1) and thus to prevent contact between said at least one gas burner arrangement (12) and said glass-ceramic flat top (1);

said elastomeric silicone body (8, 18) being configured and disposed to seal said at least one cutout portion (2) and thus minimize cooking spills spilling on said glass-ceramic flat top (1) from seeping along said elastomeric silicone body (8, 18) toward said cutout portion (2);

at least a portion of said elastomeric silicone body (8, 18) being disposed in contact with said glass-ceramic flat top (1) and being configured to be releasable from said glass-ceramic flat top (1);

said bonded elastomeric silicone body (8, 18) being configured to be removed, together with said at least one gas burner arrangement (12), with minimized damage to said elastomeric silicone body (8, 18), upon removal of said at least one gas burner (12) from said glass-ceramic flat top (1).

Another feature of the invention resides broadly in a kitchen cooking stove wherein:

said support portion (15) of said at least one gas burner arrangement (12) comprises a peripheral edge portion disposed adjacent said first surface of said glass-ceramic flat top (1);

said bonded elastomeric silicone body (8, 18) is disposed at sufficient distance from said peripheral edge portion of said support portion (15) to conceal said bonded elastomeric silicone body (8, 18) from view of a person using said kitchen cooking stove.

Yet another feature of the invention resides broadly in a kitchen cooking stove wherein:

said support portion (15) of said at least one gas burner arrangement (12) comprises a peripheral edge portion disposed adjacent said first surface of said glass-ceramic flat top (1);

said bonded elastomeric silicone body (8, 18) is disposed at said peripheral edge portion to provide a substantially continuous wall portion.

Still another feature of the invention resides broadly in a kitchen cooking stove wherein:

said support portion (15) of said at least one gas burner arrangement (12) comprises an edge portion disposed within said at least one cutout portion (2);

at least a portion of said bonded elastomeric silicone body (8, 18) is disposed at said edge portion within said at least one cutout portion (2) to protect at least one of: said at least one gas burner arrangement (12) said edge portion, upon installation and removal of said at least one gas burner arrangement (12).

A further feature of the invention resides broadly in the kitchen cooking stove wherein:

said elastomeric silicone body (8, 18) comprises a room temperature vulcanized silicone.

Another feature of the invention resides broadly in the kitchen cooking stove wherein:

said at least one gas burner arrangement (12) comprises a support arrangement (20, 21);

said support arrangement comprises a first mounting structure (21) and a second mounting structure (20);

said first and second mounting structures together being configured and disposed to mount said support portion (15) at said at least one cutout portion (2);

said bonded elastomeric silicone body (8,18) comprises a first portion adjacent said first surface of said glass-ceramic flat top (1);

said bonded elastomeric silicone body (8, 18) comprises a second portion adjacent to said second surface of said glass-ceramic flat top (1);

said first mounting structure (21) has an edge portion disposed adjacent said first surface of said glass-ceramic flat top (1);

said edge portion of said first mounting structure (21) being disposed between said support portion (15) and said first portion of said bonded elastomeric silicone body (8, 18) to shield said bonded elastomeric silicone body (8, 18) adjacent said first surface of said glass-ceramic flat top (1);

said second mounting structure (20) has an edge portion disposed adjacent said second surface of said glass-ceramic flat top (1) to shield said second portion of said bonded elastomeric silicone body (8, 18) adjacent said second surface of said glass-ceramic flat top (1).

Yet another feature of the invention resides broadly in a cooktop for preparing food; said cooktop comprising:

a top portion;

said top portion comprising a top (1);

said top (1) comprising at least one of: a glass-ceramic top, a glass top, and a ceramic top;

said top (1) having a first, upper, surface and a second, lower, surface, opposite said first surface;

at least one cutout portion (2) extending between said first surface and said second surface;

at least one gas burner arrangement (12);

said at least one gas burner arrangement (12) being disposed adjacent to said cutout portion (2);

said at least one gas burner arrangement (12) comprising a head portion (13) being configured to emit and combust a flow of gas;

at least one gas burner configuration (40) comprising a cooking utensil receiving apparatus;

said cooking utensil receiving apparatus (40) being configured to receive a bottom of a cooking utensil (42) to be heated by said at least one gas burner arrangement (12);

said at least one gas burner arrangement (12) being disposed at least with a portion (15) thereof adjacent to said at least one cutout portion (2);

said portion (15) of said at least one gas burner arrangement (12) adjacent to said cutout portion (2) comprising a support portion (15);

apparatus (14) to conduct a gas to said head portion (13) of said at least one gas burner arrangement (12);

apparatus to control (62-65) a flow of gas to said at least one gas burner arrangement (12);

a brushed on or sprayed on elastomeric silicone body (8, 18) securely attached to said support portion (15) of said at least one gas burner arrangement (12);

said elastomeric silicone body (8, 18) comprising a silicone;

said silicone being configured with a sufficient heat resistance to withstand heat produced by said at least one gas burner arrangement (12);

said elastomeric silicone body (8, 18) being securely attached to said support portion (15) and configured to remain firmly attached to said support portion (15) upon said at least one gas burner arrangement (12) being lifted from said top (1);

said elastomeric silicone body (8, 18) being configured and disposed to prevent contact between said at least one cutout portion (2) and said support portion (15) by maintaining a separation between said at least one gas burner arrangement (12) and said top (1) and thus to prevent contact between said at least one gas burner arrangement (12) and said top (1);

said elastomeric silicone body (8, 18) being configured and disposed to seal said at least one cutout portion (2) and thus minimize cooking spills spilling on said top (1) from seeping along said elastomeric silicone body (8, 18) toward said cutout portion (2);

at least a portion of said elastomeric silicone body (8, 18) being disposed in contact with said top (1) and being configured to be releasable from said top (1);

said attached elastomeric silicone body (8, 18) being configured to be lifted, together with said at least one gas burner arrangement (12), with minimized damage to said elastomeric silicone body (8, 18), upon lifting of said at least one gas burner (12) from said top (1).

Still another feature of the invention resides broadly in a cooktop wherein:

said support portion (15) of said at least one gas burner arrangement (12) comprises a peripheral edge portion disposed adjacent said first surface of said top (1);

said attached elastomeric silicone body (8, 18) is disposed at sufficient distance from said peripheral edge portion of said support portion (15) to conceal said attached elastomeric silicone body (8, 18) from view of a person using said cooktop.

A further feature of the invention resides broadly in the cooktop, wherein:

said support portion (15) of said at least one gas burner arrangement (12) comprises a peripheral edge portion disposed adjacent said first surface of said top (1);

said attached elastomeric silicone body (8, 18) is disposed at said peripheral edge portion to provide a substantially continuous wall portion.

Another feature of the invention resides broadly in a cooktop wherein:

said support portion (15) of said at least one gas burner arrangement (12) comprises an edge portion disposed within said at least one cutout portion (1);

at least a portion of said attached elastomeric silicone body (8, 18) is disposed at said edge portion within said at least one cutout portion (2) to protect at least one of: said at least one gas burner arrangement (12), and said edge portion, upon installation and removal of said at least one gas burner arrangement (12).

Yet another feature of the invention resides broadly in thee cooktop wherein:

said elastomeric silicone body (8, 18) comprises a room temperature vulcanized silicone.

Still another feature of the invention resides broadly in the cooktop wherein:

said at least one gas burner arrangement (12) comprises a support arrangement (20, 21);

said support arrangement comprises a first mounting structure (21) and a second mounting structure (20);

said first and second mounting structures together being configured and disposed to mount said support portion (15) at said at least one cutout portion (2);

said attached elastomeric silicone body (8, 18) comprises a first portion adjacent said first surface of said top (1);

said attached elastomeric silicone body (8, 18) comprises a second portion adjacent to said second surface of said top (1);

said first mounting structure (21) has an edge portion disposed adjacent said first surface of said top (1);

said edge portion of said first mounting structure (21) being disposed between said support portion (15) and said first portion of said attached elastomeric silicone body (8, 18) to shield said attached elastomeric silicone body (8, 18) adjacent said first surface of said top (1);

said second mounting structure (20) has an edge portion disposed adjacent said second surface of said top (1) to shield said second portion of said attached elastomeric silicone body (8, 18) adjacent said second surface of said top (1).

A further feature of the invention resides broadly in an appliance for preparing food, such as, a cooking stove, a gas cooking stove, a cooktop, and a gas cooktop, said appliance comprising:

a top portion;

said top portion comprising a top (1);

said top (1) comprising at least one of: a glass-ceramic top, a glass top, and a ceramic top;

said top (1) having a first, upper, surface and a second, lower, surface, opposite said first surface;

a cutout portion (2) extending between said first surface and said second surface;

a component-part comprising one of: a gas burner arrangement (12) and a venting structure (25); and a brushed on or sprayed on elastomeric silicone body (8, 18, 25) securely attached to one of (a.), (b.), and (c.):

(a.) said cutout portion (2) with said elastomeric silicon body (8) attached thereto to provide a structure receiving and mounting said component-part on said top;

at least a portion of said attached elastomeric silicone body (8) being configured to remain firmly attached at said cutout portion (2) upon displacement of said component-part from said top (1);

(b.) said gas burner arrangement (12), with said elastomeric silicone body (8, 18) attached thereto, being disposed on said top (1), a portion of said gas burner arrangement (12) being disposed within said cutout portion (2);

said attached elastomeric silicone body (8, 18) being configured to remain firmly attached to said gas burner arrangement (12) upon said gas burner arrangement (12) being displaced from said top (1);

at least a portion of said attached elastomeric silicone body (8, 18) being disposed in contact with said top (1) and being configured to be releasable from said top (1) upon displacement of said gas burner arrangement (12) from said top (1);

said attached elastomeric silicone body (8, 18,) being configured to be displaced, together with said gas burner arrangement (12), with minimized damage to said attached elastomeric silicone body (8, 18), upon displacement of said gas burner arrangement (12) from said top (1); and (c.) said venting structure (24), with said elastomeric silicone body (25) attached thereto, being disposed on said top (1), a portion of said venting structure (24) being disposed within said cutout portion (2);

said attached elastomeric silicone body (25) being configured to remain firmly attached to said venting structure (24) upon said venting structure (24) being displaced from said top (1);

at least a portion of said attached elastomeric silicone body (25) being disposed in contact with said top (1) and being configured to be releasable from said top (1) upon displacement of said venting structure (24) from said top (1); and said attached elastomeric silicone body (25) being configured to be displaced, together with said at least one venting structure (24), with minimized damage to said attached elastomeric silicone body (25), upon displacement of said venting structure (24) from said top (1);

said elastomeric silicone body (8, 18, 25) comprising a silicone;

said silicone being configured with a sufficient heat resistance to withstand heat produced by said appliance;

said elastomeric silicone body (8, 18, 25) being configured and disposed to prevent contact between said cutout portion (2) and its corresponding component-part by maintaining a separation between its corresponding component-part and said top (1) and thus to prevent contact between its corresponding component-part and said top (1);

said elastomeric silicone body (8, 18, 25) being configured and disposed to seal said cutout portion (2) and thus minimize cooking spills spilling on said top (1) from seeping along said elastomeric silicone body (8, 18) toward said cutout portion (2).

Another feature of the invention resides broadly in a appliance wherein:

said gas burner arrangement (12) comprises a support portion (15;

said support portion (15) of said gas burner arrangement (12) comprises a peripheral edge portion disposed adjacent said first surface of said top (1);

said attached elastomeric silicone body (8, 18) is disposed at sufficient distance from said peripheral edge portion of said support portion (15) to conceal said attached elastomeric silicone body (8, 18) from view of a person using said appliance.

Yet another feature of the invention resides broadly in the appliance wherein:

said gas burner arrangement (12) comprises a support portion (15);

said support portion (15) of said gas burner arrangement (12) comprises a peripheral edge portion disposed adjacent said first surface of said top (1);

said attached elastomeric silicone body (8, 18) is disposed at said peripheral edge portion to provide a substantially continuous wall portion.

Still another feature of the invention resides broadly in the appliance wherein:

said gas burner arrangement comprises a support portion (15);

said support portion (15) of said gas burner arrangement (12) comprises an edge portion disposed within said cutout portion (2);

at least a portion of said attached elastomeric silicone body (8, 18) is disposed at said edge portion within said cutout portion (2) to protect said edge portion.

A further feature of the invention resides broadly in the appliance wherein:

said elastomeric silicone body (8, 18, 25) comprises a room temperature vulcanized silicone.

Another feature of the invention resides broadly in the cooktop wherein:

said gas burner arrangement (12) comprises a support arrangement (20, 21);

said support arrangement comprises a first mounting structure (21) and a second mounting structure (20);

said first and second mounting structures together being configured and disposed to mount said support portion (15) at said cutout portion (2);

said attached elastomeric silicone body (8, 18) comprises a first portion adjacent said first surface of said top (1);

said attached elastomeric silicone body (8, 18) comprises a second portion adjacent to said second surface of said top (1);

said first mounting structure (21) has an edge portion disposed adjacent said first surface of said top (1);

said edge portion of said first mounting structure (21) being disposed between said support portion (15) and said first portion of said attached elastomeric silicone body (8, 18) to shield said attached elastomeric silicone body (8, 18) adjacent said first surface of said top (1);

said second mounting structure (20) has an edge portion disposed adjacent said second surface of said top (1) to shield said second portion of said attached elastomeric silicone body (8, 18) adjacent said second surface of said top (1).

Yet another feature of the invention resides broadly in the appliance wherein:

said attached elastomeric silicone body (8, 18) comprises at least one of: a portion disposed substantially concentric with said cutout portion (2), a portion disposed on said first surface of said top (1), and a portion disposed on said second surface of said top (1).

Still another feature of the invention resides broadly in the appliance wherein:

said venting structure (24) comprises at least one of (d.), (e.), and (f.):

(d.) a support portion of said venting structure;

said support portion of said venting structure arrangement comprises a peripheral edge portion disposed adjacent said first surface of said top; said attached elastomeric silicone body (25) is disposed at sufficient distance from said peripheral edge portion of said support portion to conceal said attached elastomeric silicone body (25) from view of a person using said appliance;

(e.) a support portion of said venting structure;

said support portion of said venting structure (24) comprises a peripheral edge portion disposed adjacent said first surface of said top; said attached elastomeric silicone body (25) is disposed at said peripheral edge portion to provide a substantially continuous wall portion; and (f.) a support portion of said venting structure;

said support portion of said venting structure (24) comprises an edge portion disposed within said cutout portion; at least a portion of said attached elastomeric silicone body (25) is disposed at said edge portion within said cutout portion to protect at least one of: said venting structure, and said edge portion, upon installation and removal of said venting structure;

said appliance further comprises an outer peripheral portion on said venting structure (24);

said attached elastomeric silicone body (25) extends to said outer peripheral portion of said venting structure (24);

said cutout portion (2) has walls extending between said first surface and said second surface;

said attached elastomeric silicone body (8, 18, 25) comprises at least one of: a portion disposed on said walls of said cutout portion, a portion disposed on said first surface of said top, and a portion disposed on said second surface of said top; and said attached elastomeric silicone body (8, 18, 25) comprises a room temperature vulcanized silicone.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A kitchen cooking stove for preparing food, such as, cooking frying, roasting, sautéing, and boiling food, said stove comprising:

a stove body;

said stove body being configured with a support to support said stove body;

said stove body being configured with a cook top to prepare food;

said cook top comprising a portion;

said portion comprising a glass-ceramic flat top;

said glass-ceramic flat top having a first, upper, surface and a second, lower, surface, opposite said first surface;

at least one cutout portion extending between said first surface and said second surface;

at least one gas burner arrangement;

said at least one gas burner arrangement being disposed adjacent to said at least one cutout portion;

said at least one gas burner arrangement comprising a head portion being configured to emit and combust a flow of gas;

at least one gas burner configuration comprising a cooking utensil receiving apparatus;

said cooking utensil receiving apparatus being configured to receive a bottom of a cooking utensil to be heated by said at least one gas burner arrangement;

said at least one gas burner arrangement being disposed at least with a portion thereof adjacent to said at least one cutout portion;

said portion of said at least one gas burner arrangement adjacent to said at least one cutout portion comprising a support portion;

apparatus to conduct a gas to said head portion of said at least one gas burner arrangement;

apparatus to control a flow of gas to said at least one gas burner arrangement;

a brushed on or sprayed on elastomeric silicone body securely bonded to said support portion of said at least one gas burner arrangement;

said elastomeric silicone body comprising a silicone;

said silicone being configured with a sufficient heat resistance to withstand heat produced by said at least one gas burner arrangement;

said elastomeric silicone body being securely bonded to said support portion and configured to remain firmly attached to said support portion upon said at least one gas burner arrangement being removed from said glass-ceramic flat top;

said elastomeric silicone body being configured and disposed to prevent contact between said at least one cutout portion and said support portion by maintaining a separation between said at least one gas burner arrangement and said glass-ceramic flat top and thus to prevent contact between said at least one gas burner arrangement and said glass-ceramic flat top;

said elastomeric silicone body being configured and disposed to seal said at least one cutout portion and thus minimize cooking spills spilling on said glass-ceramic flat top from seeping along said elastomeric silicone body toward said cutout portion;

at least a portion of said elastomeric silicone body being disposed in contact with said glass-ceramic flat top and being configured to be releasable from said glass-ceramic flat top;

said bonded elastomeric silicone body being configured to be removed, together with said at least one gas burner arrangement, with minimized damage to said elastomeric silicone body, upon removal of said at least one gas burner from said glass-ceramic flat top.

2. The kitchen cooking stove according to claim 1, wherein:

said support portion of said at least one gas burner arrangement comprises a peripheral edge portion disposed adjacent said first surface of said glass-ceramic flat top;

said bonded elastomeric silicone body is disposed at sufficient distance from said peripheral edge portion of said support portion to conceal said bonded elastomeric silicone body from view of a person using said kitchen cooking stove.

3. The kitchen cooking stove according to claim 1, wherein:

said support portion of said at least one gas burner arrangement comprises a peripheral edge portion disposed adjacent said first surface of said glass-ceramic flat top;

said bonded elastomeric silicone body is disposed at said peripheral edge portion to provide a substantially continuous wall portion.

4. The kitchen cooking stove according to claim 1, wherein:

said support portion of said at least one gas burner arrangement comprises an edge portion disposed within said at least one cutout portion;

at least a portion of said bonded elastomeric silicone body is disposed at said edge portion within said at least one cutout portion to protect at least one of: said at least one gas burner arrangement, and said edge portion, upon installation and removal of said at least one gas burner arrangement.

5. The kitchen cooking stove according to claim 4, wherein:

said elastomeric silicone body comprises a room temperature vulcanized silicone.

6. The kitchen cooking stove according to claim 1, wherein:

said at least one gas burner arrangement comprises a support arrangement;

said support arrangement comprises a first mounting structure and a second mounting structure;

said first and second mounting structures together being configured and disposed to mount said support portion at said at least one cutout portion;

said bonded elastomeric silicone body comprises a first portion adjacent said first surface of said glass-ceramic flat top;

said bonded elastomeric silicone body comprises a second portion adjacent to said second surface of said glass-ceramic flat top;

said first mounting structure has an edge portion disposed adjacent said first surface of said glass-ceramic flat top;

said edge portion of said first mounting structure being disposed between said support portion and said first portion of said bonded elastomeric silicone body to shield said bonded elastomeric silicone body adjacent said first surface of said glass-ceramic flat top;

said second mounting structure has an edge portion disposed adjacent said second surface of said glass-ceramic flat top to shield said second portion of said bonded elastomeric silicone body adjacent said second surface of said glass-ceramic flat top.

7. A cooktop for preparing food; said cooktop comprising:

a top portion;

said top portion comprising a top;

said top comprising at least one of: a glass-ceramic top, a glass top, and a ceramic top;

said top having a first, upper, surface and a second, lower, surface, opposite said first surface;

at least one cutout portion extending between said first surface and said second surface;

at least one gas burner arrangement;

said at least one gas burner arrangement being disposed adjacent to said cutout portion;

said at least one gas burner arrangement comprising a head portion being configured to emit and combust a flow of gas;

at least one gas burner configuration comprising a cooking utensil receiving apparatus;

said cooking utensil receiving apparatus being configured to receive a bottom of a cooking utensil to be heated by said at least one gas burner arrangement;

said at least one gas burner arrangement being disposed at least with a portion thereof adjacent to said at least one cutout portion;

said portion of said at least one gas burner arrangement adjacent to said cutout portion comprising a support portion;

apparatus to conduct a gas to said head portion of said at least one gas burner arrangement;

apparatus to control a flow of gas to said at least one gas burner arrangement;

a brushed on or sprayed on elastomeric silicone body securely attached to said support portion of said at least one gas burner arrangement;

said elastomeric silicone body comprising a silicone;

said silicone being configured with a sufficient heat resistance to withstand heat produced by said at least one gas burner arrangement;

said elastomeric silicone body being securely attached to said support portion and configured to remain firmly attached to said support portion upon said at least one gas burner arrangement being lifted from said top;

said elastomeric silicone body being configured and disposed to prevent contact between said at least one cutout portion and said support portion by maintaining a separation between said at least one gas burner arrangement and said top and thus to prevent contact between said at least one gas burner arrangement and said top;

said elastomeric silicone body being configured and disposed to seal said at least one cutout portion and thus minimize cooking spills spilling on said top from seeping along said elastomeric silicone body toward said cutout portion;

at least a portion of said elastomeric silicone body being disposed in contact with said top and being configured to be releasable from said top;

said attached elastomeric silicone body being configured to be lifted, together with said at least one gas burner arrangement, with minimized damage to said elastomeric silicone body, upon lifting of said at least one gas burner from said top.

8. The cooktop according to claim 7, wherein:

said support portion of said at least one gas burner arrangement comprises a peripheral edge portion disposed adjacent said first surface of said top;

said attached elastomeric silicone body is disposed at sufficient distance from said peripheral edge portion of said support portion to conceal said attached elastomeric silicone body from view of a person using said cooktop.

9. The cooktop according to claim 7, wherein:

said support portion of said at least one gas burner arrangement comprises a peripheral edge portion disposed adjacent said first surface of said top;

said attached elastomeric silicone body is disposed at said peripheral edge portion to provide a substantially continuous wall portion.

10. The cooktop according to claim 8, wherein:

said support portion of said at least one gas burner arrangement comprises an edge portion disposed within said at least one cutout portion;

at least a portion of said attached elastomeric silicone body is disposed at said edge portion within said at least one cutout portion to protect at least one of: said at least one burner arrangement, and said edge portion, upon installation of said at least one gas burner arrangement.

11. The cooktop according to claim 10, wherein:

said elastomeric silicone body comprises a room temperature vulcanized silicone.

12. The cooktop according to claim 7, wherein:

said at least one gas burner arrangement comprises a support arrangement;

said support arrangement comprises a first mounting structure and a second mounting structure;

said first and second mounting structures together being configured and disposed to mount said support portion at said at least one cutout portion said attached elastomeric silicone body comprises a first portion adjacent said first surface of said top;

said attached elastomeric silicone body comprises a second portion adjacent to said second surface of said top;

said first mounting structure has an edge portion disposed adjacent said first surface of said top;

said edge portion of said first mounting structure being disposed between said support portion and said first portion of said attached elastomeric silicone body to shield said attached elastomeric silicone body adjacent said first surface of said top;

said second mounting structure has an edge portion disposed adjacent said second surface of said top to shield said second portion of said attached elastomeric silicone body adjacent said second surface of said top.

13. An appliance for preparing food, such as, a cooking stove, a gas cooking stove, a cooktop, and a gas cooktop, said appliance comprising:

a top portion;

said top portion comprising a top;

said top comprising at least one of: a glass-ceramic top, a glass top, and a ceramic top;

said top having a first, upper, surface and a second, lower, surface, opposite said first surface;

a cutout portion extending between said first surface and said second surface;

a component-part comprising one of: a gas burner arrangement and a venting structure; and a brushed on or sprayed on elastomeric silicone body securely attached to one of (a.), (b.), and (c.):

(a.) said cutout portion with said elastomeric silicon body attached thereto to provide a structure receiving and mounting said component-part on said top;

at least a portion of said attached elastomeric silicone body being configured to remain firmly attached at said cutout portion upon displacement of said component-part from said top;

(b.) said gas burner arrangement, with said elastomeric silicone body attached thereto, being disposed on said top, a portion of said gas burner arrangement being disposed within said cutout portion;

said attached elastomeric silicone body being configured to remain firmly attached to said gas burner arrangement upon said gas burner arrangement being displaced from said top;

at least a portion of said attached elastomeric silicone body being disposed in contact with said top and being configured to be releasable from said top upon displacement of said gas burner arrangement from said top;

said attached elastomeric silicone body being configured to be displaced, together with said gas burner arrangement, with minimized damage to said attached elastomeric silicone body, upon displacement of said gas burner arrangement from said top; and (c.) said venting structure, with said elastomeric silicone body attached thereto, being disposed on said top, a portion of said venting structure being disposed within said cutout portion;

said attached elastomeric silicone body being configured to remain firmly attached to said venting structure upon said venting structure being displaced from said top;

at least a portion of said attached elastomeric silicone body being disposed in contact with said top and being configured to be releasable from said top upon displacement of said venting structure from said top; and said attached elastomeric silicone body being configured to be displaced, together with said at least one venting structure, with minimized damage to said attached elastomeric silicone body, upon displacement of said venting structure from said top;

said elastomeric silicone body comprising a silicone;

said silicone being configured with a sufficient heat resistance to withstand heat produced by said appliance;

said elastomeric silicone body being configured and disposed to prevent contact between said cutout portion and its corresponding component-part by maintaining a separation between its corresponding component-part and said top and thus to prevent contact between its corresponding component-part and said top;

said elastomeric silicone body being configured and disposed to seal said cutout portion and thus minimize cooking spills spilling on said top from seeping along said elastomeric silicone body toward said cutout portion.

14. The appliance according to claim 13, wherein:

said gas burner arrangement comprises a support portion;

said support portion of said gas burner arrangement comprises a peripheral edge portion disposed adjacent said first surface of said top;

said attached elastomeric silicone body is disposed at sufficient distance from said peripheral edge portion of said support portion to conceal said attached elastomeric silicone body from view of a person using said appliance.

15. The appliance according to claim 13, wherein:

said gas burner arrangement comprises a support portion;

said support portion of said gas burner arrangement comprises a peripheral edge portion disposed adjacent said first surface of said top;

said attached elastomeric silicone body is disposed at said peripheral edge portion to provide a substantially continuous wall portion.

16. The appliance according to claim 13, wherein:

said gas burner arrangement comprises a support portion;

said support portion of said gas burner arrangement comprises an edge portion disposed within said cutout portion;

at least a portion of said attached elastomeric silicone body is disposed at said edge portion within said cutout portion to protect at least one of: said gas burner arrangement, and said edge portion, upon installation and removal of said gas burner arrangement.

17. The appliance according to claim 14, wherein:

said elastomeric silicone body comprises a room temperature vulcanized silicone.

18. The cooktop according to claim 17, wherein:

said gas burner arrangement comprises a support arrangement;

said support arrangement comprises a first mounting structure and a second mounting structure;

said first and second mounting structures together being configured and disposed to mount said support portion at said cutout portion;

said attached elastomeric silicone body comprises a first portion adjacent said first surface of said top;

said attached elastomeric silicone body comprises a second portion adjacent to said second surface of said top;

said first mounting structure has an edge portion disposed adjacent said first surface of said top;

said edge portion of said first mounting structure being disposed between said support portion and said first portion of said attached elastomeric silicone body to shield said attached elastomeric silicone body adjacent said first surface of said top;

said second mounting structure has an edge portion disposed adjacent said second surface of said top to shield said second portion of said attached elastomeric silicone body adjacent said second surface of said top.

19. The appliance according to claim 18, wherein:

said attached elastomeric silicone body comprises at least one of: a portion disposed substantially concentric with said cutout portion, a portion disposed on said first surface of said top, and a portion disposed on said second surface of said top.

20. The appliance according to claim 13, wherein:

said venting structure comprises at least one of (d.), (e.), and (d.) a support portion of said venting structure;

said support portion of said venting structure arrangement comprises a peripheral edge portion disposed adjacent said first surface of said top; said attached elastomeric silicone body is disposed at sufficient distance from said peripheral edge portion of said support portion to conceal said attached elastomeric silicone body from view of a person using said appliance;

(e.) a support portion of said venting structure;

said support portion of said venting structure comprises a peripheral edge portion disposed adjacent said first surface of said top; said attached elastomeric silicone body is disposed at said peripheral edge portion to provide a substantially continuous wall portion; and (f.) a support portion of said venting structure;

said support portion of said venting structure comprises an edge portion disposed within said cutout portion; at least a portion of said attached elastomeric silicone body is disposed at said edge portion within said cutout portion to protect at least one of: said venting structure, and said edge portion, upon installation and removal of said venting structure;

said appliance further comprises an outer peripheral portion on said venting structure;

said attached elastomeric silicone body extends to said outer peripheral portion of said venting structure;

said cutout portion has walls extending between said first surface and said second surface;

said attached elastomeric silicone body comprises at least one of: a portion disposed on said walls of said cutout portion, a portion disposed on said first surface of said top, and a portion disposed on said second surface of said top; and said attached elastomeric silicone body comprises a room temperature vulcanized silicone.

21. The appliance according to claim 13, wherein said elastomeric silicone body, said component part, and said cutout portion are configured to minimize reinstallation time of said component part upon removal of said component part from said top portion and subsequent reinstallation of said component part in said top portion.

* * * * *

UNITED STATES PATENT AND TRADEMARK OFFICE

CERTIFICATE OF CORRECTION

PATENT NO. : 6,807,962 B2
DATED : October 26, 2004
INVENTOR(S) : Martin Taplan and Thedore Allen Wegert It is certified that error appears in the above-identified patent and that said Letters Patent is hereby corrected as shown below:

Column 12,
Line 9, after “entitled,” delete ““efficient,” and insert -- “Efficient, --.

Column 27,
Line 34, after “and” insert -- (f.); --.

Signed and Sealed this

Fifteenth Day of March, 2005

JON W. DUDAS
*Director of the United States Patent and Trademark Office*